US007096964B2

(12) United States Patent
Dushkin et al.

(10) Patent No.: US 7,096,964 B2
(45) Date of Patent: Aug. 29, 2006

(54) SPRINKLERS

(75) Inventors: Andrey Leonidovich Dushkin, Moscow (RU); Alexandr Vladimirovich Karpyshev, Moscow (RU)

(73) Assignee: Obschestvo S Organichennoi Otvetstvennostju "Unipat", (RU)

( * ) Notice: Subject to any disclaimer, the term of this patent is extended or adjusted under 35 U.S.C. 154(b) by 0 days.

(21) Appl. No.: 11/065,129

(22) Filed: Feb. 24, 2005

(65) Prior Publication Data

US 2005/0139364 A1 Jun. 30, 2005

Related U.S. Application Data

(62) Division of application No. 10/240,419, filed as application No. PCT/RU00/00298 on Jul. 17, 2000, now Pat. No. 6,964,307.

(30) Foreign Application Priority Data

Mar. 28, 2000 (RU) ..... 2000107338

(51) Int. Cl.
*A62C 37/08* (2006.01)

(52) U.S. Cl. ..... 169/37; 169/38; 169/41; 169/42; 169/56; 169/57; 239/498; 239/504; 239/589; 239/591

(58) Field of Classification Search ..... 169/37–42, 169/56, 57, 90; 239/589, 590, 591, 498, 239/499, 504

See application file for complete search history.

(56) References Cited

U.S. PATENT DOCUMENTS

| | | | | |
|---|---|---|---|---|
| 1,118,118 A | | 11/1914 | Fischer | |
| 1,395,442 A | | 11/1921 | Macgregor | |
| 2,134,347 A | | 10/1938 | Thompson | |
| 2,553,726 A | * | 5/1951 | Rowley | 169/38 |
| 4,015,665 A | | 4/1977 | Simons et al. | |
| 4,800,961 A | | 1/1989 | Klein | |
| 4,896,728 A | | 1/1990 | Wolff et al. | |
| 5,303,778 A | * | 4/1994 | Vari | 169/90 |
| 5,392,993 A | | 2/1995 | Fischer | |
| 5,667,017 A | | 9/1997 | Hoffmann et al. | |
| 5,839,667 A | | 11/1998 | Fischer | |
| 6,112,820 A | * | 9/2000 | Job et al. | 169/37 |
| 6,129,165 A | | 10/2000 | Hoffmann et al. | |

FOREIGN PATENT DOCUMENTS

| | | |
|---|---|---|
| DE | 233 490 A1 | 3/1986 |
| EP | 0 701 842 B1 | 3/1996 |
| GB | 548790 A | 10/1942 |

(Continued)

*Primary Examiner*—Steven J. Ganey
(74) *Attorney, Agent, or Firm*—Rothwell, Figg, Ernst & Manbeck, PC

(57) ABSTRACT

The sprinkler includes the following structural members: a body (1) with a channel for liquid supply, a thermally responsive unit with a valve (4) closing the sprinkler outlet, and a thermally responsive unit attachment. In the first alternative embodiment a sprinkler channel is formed by a segment (10) of a cylindrical configuration connected with a segment (11) made as a conical diffuser. To generate a fine uniform gas-and-drop stream of a high kinetic energy and space-uniform distribution the cylindrical segment (10) length exceeds the channel diameter at this segment. The segment (11) length in the form of conical diffuser exceeds the channel diameter at the cylindrical segment (10). In the second alternative embodiment the sprinkler has two coaxial liquid supply channels. The length of the axial cylindrical channel exceeds its diameter. The second annular channel is coaxial to the first channel and fitted with helical guide components.

3 Claims, 2 Drawing Sheets

FOREIGN PATENT DOCUMENTS

| | | | |
|---|---|---|---|
| RU | 643162 | | 8/1977 |
| RU | 2159649 | C1 | 11/2000 |
| SU | 1313450 | A1 | 5/1987 |
| SU | 1676641 | A1 | 9/1991 |
| SU | 1678393 | A1 | 9/1991 |
| WO | WO 01/72375 | A1 | 10/2001 |

* cited by examiner

SPRINKLERS

CROSS-REFERENCE TO RELATED APPLICATIONS

This application is a division of U.S. application Ser. No. 10/240,419, filed Sep. 30, 2002, now U.S. Pat. No. 6,964, 307, which is a §371 of International Application Serial No. PCT/RU00/00298, filed Jul. 17, 2000.

FIELD OF THE INVENTION

The invention relates to fire fighting equipment, namely, sprinkler devices for local extinguishing of the fires in buildings with a large number of possible fire sites, for instance, in hospitals, libraries, museums, offices, department stores, storehouses, garages. These devices are usually used as structural parts of automatic extinguishing systems.

DESCRIPTION OF THE BACKGROUND ART

Known in the art are different types of a sprinkler applied in fire extinguishing equipment. These prior art devices differ both in types of thermally responsive units used as their structural components and channel configuration through which the fire extinguishing liquid is supplied.

For instance, known in the art are sprinklers having a body with an axial cylindrical channel for liquid supply, a thermally responsive unit with a valve closing the sprinkler outlet, and a thermally responsive unit attachment (patent U.S. Pat. No. 5,392,993, B05B 1/26, published Feb. 28, 1995). The design feature of this sprinkler is configuration embodiment of a liquid stream diffuser element fixed opposite the channel outlet. The improvement described in U.S. Pat. No. 5,392,993 has been designed to generate a gas-and-drop stream of a certain spatial configuration, which is the most optimum one for fire extinguishing, as well as a drop size change in the stream generated and their specific distribution (by their size) in the stream generated. However, this technical decision is characterized by a complex structure and limited possibilities.

Known in the art are also other technical decisions, among which another sprinkler may be noted described in U.S. Pat. No. 4,800,961 (A62C 37/10, published Jan. 1, 1989). A common sprinkler has a body with liquid supply channel, a thermally responsive component with a valve closing the sprinkler outlet and thermally responsive unit attachment. The sprinkler channel is formed by a few sequentially connected segments of different shape and different passage cross-section. The first segment of the channel from the liquid supply side is a conical diffuser with an aperture angle of about 8°. The first segment is connected to the second one having the form of a conical diffuser with an aperture angle of about 60°. The third segment of the channel is of a cylindrical shape, the diameter of which equals to that of conical diffuser outlet cross-section. The diffuser channel outlet is formed by an annular projection. A flat surface of the annular projection having a minimum longitudinal size is oriented perpendicular to a liquid stream direction in the sprinkler channel. This configuration of sprinkler channel embodiment provides generation of larger drops on account of a stream speed decrease at the channel outlet. As a result the sprinkler produces a gas-and-drop stream with a desired liquid distribution by its drop sizes for effective extinguishing. Large drops are in the central part of the stream, which is directly used for extinguishing the flame. The drops of a relatively small size are in the peripheral part of the gas-and-drop stream to reduce the smoke gas temperature or cool the environment.

The sprinkler structure described allows, on the whole, to reduce non-productive liquid consumption. However, a part of energy inputs for gas-and-drop stream generation is non-productively spent in braking a peripheral part of the liquid stream at the cylindrical portion of the channel in front of the annular projection.

The most closely analogous device of the first alternative embodiment of the invention is a sprinkler described in the Author's Certificate USSR NQ 643162 (A62C 37/12, published Jan. 1, 1979), which has a body with a liquid supply channel, a thermally responsive unit with a valve, which closes the sprinkler outlet, and the thermally responsive unit attachment. The sprinkler channel is formed by a segment of a cylindrical shape connected with a segment in the form of a conical diffuser. However, the sprinkler channel dimensions and configuration were not optimized in the said structure, which is necessary for effective liquid spray over the fire site. Together with this the prior sprinkler does not allow to generate a uniform finely-dispersed gas-and-drop liquid stream of a high kinetic energy of the drops at the fire surface.

The most closely analogous device of the second alternative embodiment of the invention is a sprinkler described in a European application EP 0701842 A2 (A62C 37/08, published Mar. 3, 1996), which has a body with liquid supply channels, a thermally responsive component with a valve, which closes the sprinkler outlet, and the thermally responsive component attachment. One of the sprinkler channels is made in the form of an axial cylindrical channel, the length of which exceeds its diameter, and the second one in the form of an annual channel with helical guide components coaxial to the first channel. This technical decision is aimed at a gas-and-drop stream generation with an optimum size of the drops and uniform distribution in space, which allows to effectively use the liquid for fire extinguishing. It should be noted that the structure of the prior art sprinkler does not provide effective fire extinguishing on a large area, as at the sprinkler outlet a gas-and-drop stream is generated, the cross-section of which is limited by the edges of a common outlet. In this case it is required to increase sprinkler arrangement density on the ceiling of the room.

SUMMARY OF THE INVENTION

The invention patented is aimed at developing a sprinkler structure, which provides generation of a uniform finely-dispersed gas-and-drop stream with a high kinetic energy of the drops and their uniform distribution in space. The solution of this problem allows to increase a sprinkling area with a desired intensity and kinetic energy of the drops necessary for effective extinguishing a fire site. In other words, the invention is aimed at increasing the area of the room protected against the fire. In addition, the invention is aimed at decreasing power and liquid consumption for a gas-and-drop stream generation possessing the listed advantages.

The above object is accomplished by the fact that a sprinkler has a body with a liquid supply channel, which is formed by a segment of a cylindrical shape connected with a segment made in the form of a conical diffuser, a thermal responsive unit with a valve and a thermal responsive unit attachment. Herein, according to the invention, the length of a cylindrical segment exceeds the channel diameter of this segment, the length of the segment in the form of conical diffuser exceeds the channel diameter at the cylindrical segment, the angle at the cone apex forming the surface of a conical diffuser is from 10° to 50°.

The length of a cylindrical segment of the sprinkler channel does not preferably exceed three diameters of the channel at this segment.

The thermally responsive unit attachment can be embodied in the form of frame arms embracing the thermally responsive unit.

The above object is also accomplished by the fact that a sprinkler in its second alternative embodiment contains a body with liquid supply channels, one of which is made in the form of an axial channel of a cylindrical configuration, the length of which exceeds its diameter, and the second one is the form of an annular channel with helical guide components coaxial to the first channel, a thermally responsive unit with a valve and the thermally responsive unit attachment point. Herein, according to the invention, the sprinkler outlet is formed by the axial cylindrical channel outlet and the annular channel outlet distant from the former in the radial direction, the annular channel having helical guide components.

The outlet diameter of an axial cylindrical channel of the sprinkler in a preferred embodiment is 0.2 to 0.4 of an average diameter of the annular outlet of a coaxial channel.

The length of an axial cylindrical sprinkler channel is preferably from one to two of its diameters.

In a preferred embodiment the helical guide components of the annual channel of the sprinkler are made in the form of a multiple-thread screw. In addition, the helical guide components of the annular channel of the sprinkler are preferably used in the form of a four-thread screw. In this case a reliable generation of a uniform conical sheet at the annual channel outlet is provided.

In a most preferred embodiment the helical guide components of the annular channel of a sprinkler are made in the form of a multi-thread screw. The screw channel inclination angle to the axis of symmetry of an axial channel is 20° to 30°. At these inclination angles the generation of a conical sheet-type stream with optimum aperture angles and tangential speeds of the drops, which provide the most effective crushing of sheet-type streams, is obtained.

A thermally responsive unit attachment point in the above sprinkler embodiment can also be made in the form of frame arms embracing the thermally responsive unit.

BRIEF DESCRIPTION OF THE DRAWINGS

The invention will now be described with reference to a specific embodiment illustrated in the accompanying drawings, wherein.

DETAILED DESCRIPTION OF THE INVENTION

Figure 1:
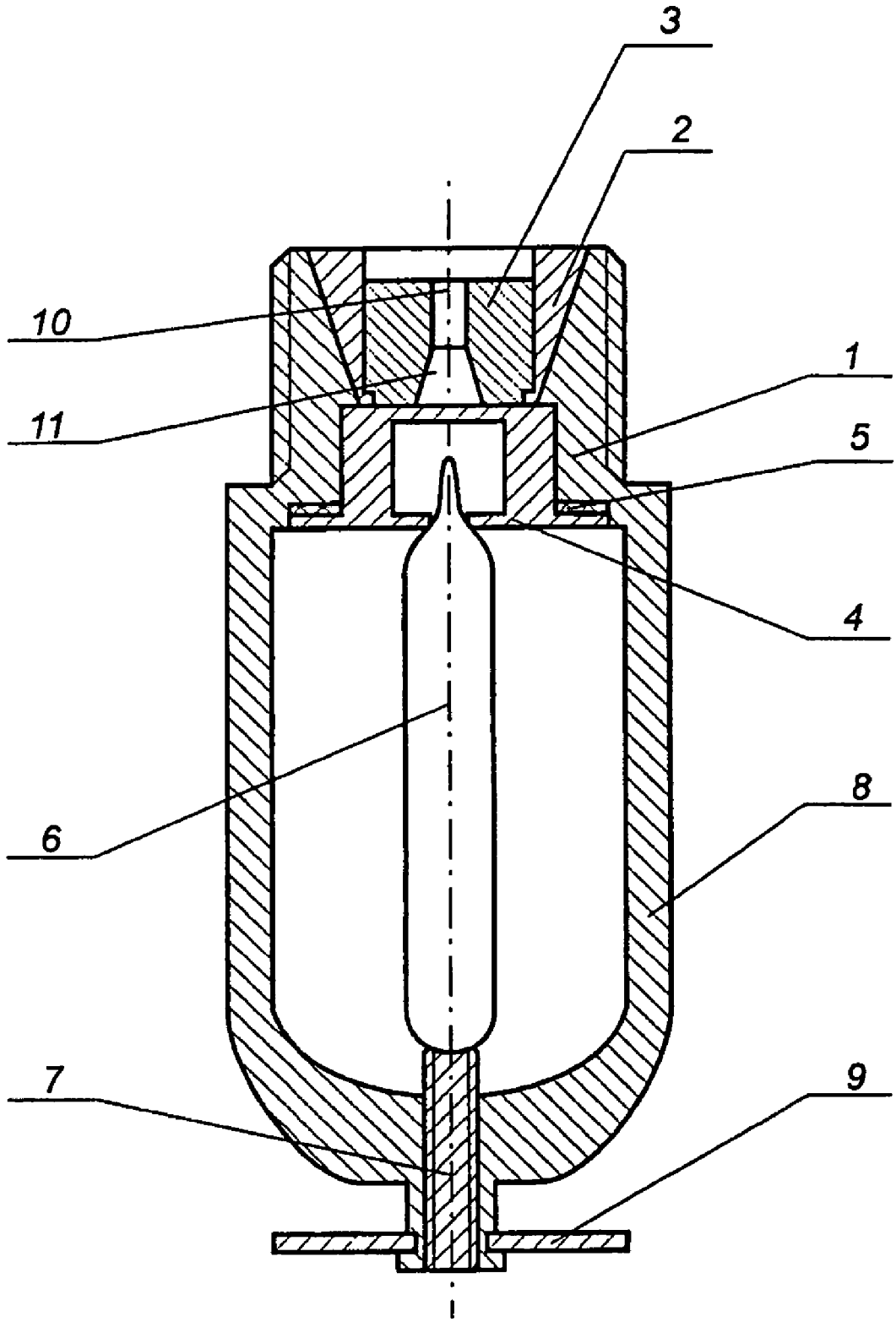
FIG. 1 is a schematic sectional view of a sprinkler designed according to the first embodiment (in the plane of frame arm location)

A sprinkler according to the first embodiment of the invention (see FIG. 1) has a body 1, the upper part of which contains a coupling point for connecting with the main liquid supply pipe. The body 1 has a through channel, which has a sealing ring 2 to fix an insertion-sprinkler 3. The channel of the body 1 has a thermally responsive unit valve 4 sealed by sealing 5. The valve 4 is held in its initial position by means of a thermally responsive unit bulb 6 made of fragile material. The bulb 6 is fixed in a desired position by a set screw 7.

In its initial position the thermally responsive unit ensures the valve 5 sealing, which closes the sprinkler outlet. The thermally responsive unit attachment is made in the form of frame arms 8 symmetrically positioned around the bulb 6 (frame arms 8 embrace the thermally responsive unit). These frame arms 8 may be either members of the body 1, or made as separate components fixed on the body 1. A diffuser element 9 of a gas-and-drop stream (a rosette) is attached to the frame arms 8.

A liquid supply channel made in the insertion-sprinkler 3 is formed by a segment 10 of a cylindrical shape, smoothly joined with segment 11 made in the form of a conical diffuser. According to the invention the length of a cylindrical segment 10 exceeds the channel diameter at this segment. The length of segment 11 in the form of a conical diffuser exceeds the channel diameter at the cylindrical segment 10. The angle at the cone apex forming the conical diffuser surface is 10° to 50°. Herein the length of a cylindrical segment 10 is elected not more than three diameters of the channel at this segment (otherwise the sprinkler dimensions increase without performance improvement).

Figure 2:
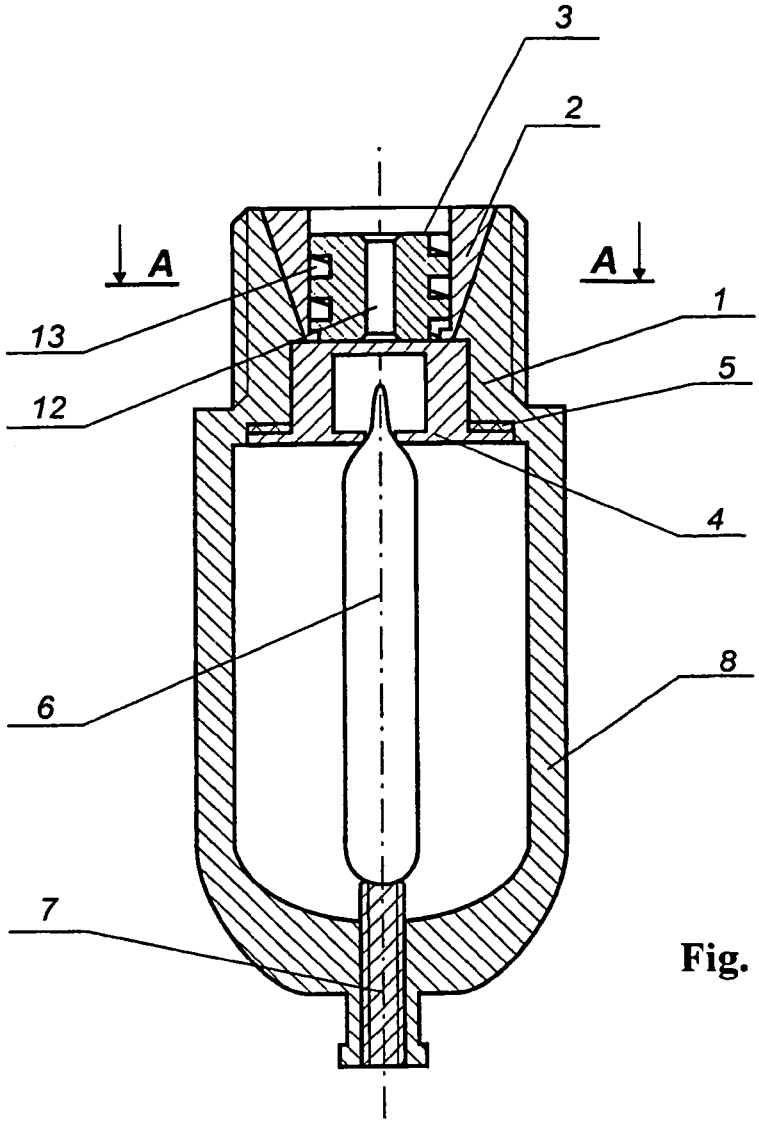
FIG. 2 is schematic sectional view of a sprinkler designed according to the second embodiment (in the plane of frame arm location)
Figure 3:
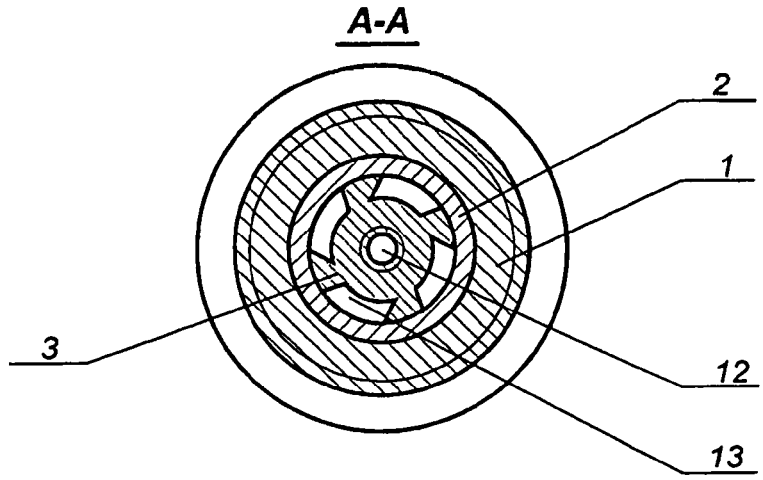
FIG. 3 is a transverse sectional view of a sprinkler illustrated in FIG. 2 in plane A—A.

A sprinkler according to a second embodiment of the invention (see FIGS. 2 and 3) has the same structural components as in the first one (see FIG. 1). The distinction is in the form of insertion-sprayer 3 embodiment and, respectively, liquid supply channel embodiment. In the above alternative embodiment the sprinkler has two coaxial liquid supply channels. One of them is formed by a coaxial channel 12 of a cylindrical shape, the length of which does not exceed its diameter. The second channel is made in the form of an annual channel 13 with helical guide components, coaxial to the first channel.

The sprinkler feature according to the second alternative embodiment of the invention is the shape and arrangement of its outlets. The sprinkler outlet is formed by the orifice of an axial channel 12 and an orifice of the annular channel 13 distant from the former in the radial direction. In a particular embodiment the channel 12 orifice diameter is selected to be equal to 0.2 to 0.4 from the average diameter of the annular channel 13 orifice. A preferred diameter correlation of channels 12 and 13 is selected equal to 0.3. The said diameter correlation of channels 12 and 13 forming a sprinkler outlet is caused by an optimum size of the drops generated in the stream, their spray range (kinetic energy) and spray uniformity of a certain fire site area. The length of the axial cylindrical channel 12 is preferably selected from 1 to 2 of its diameters.

In addition the sprinkler design in its second alternative embodiment has no gas-and-drop stream diffuser element 9. Its functions are provided by mutual collision and mixing of sheet-type streams of a certain configuration, which are formed in liquid flowing through the axial channel 12 and the annual channel 13.

The helical guide components of the annular channel 13 are embodied in the form of a multiple-thread screw. In the sprinkler embodiment studied the helical guide components of the annual channel 13 have a four-thread screw shape form to reliably generate a uniform sheet of a conical configuration. An inclination angle of particular channels formed by a multi-thread screw to the axis of symmetry of the axial channel 12 is 20° to 30°. In this case a sheet-type stream with optimum aperture angles and tangential speeds of the drops is yielded. The channel cross-section formed by a screw is of a rectangular shape close to a square. The sizes of these channels are selected depending on the required flow through the annular channel 13, which, in its turn, depends on the flow through the axial channel 12.

The sprinkler, the structure of which corresponds to the first alternate embodiment of the invention, functions in the following manner.

Water is fed into the sprinkler under a higher pressure than that which causes cavitation (for water P>0.25 MPa). The pressure value is approximately 1 MPa. The static pressure at the cylindrical segment 10 outlet falls to the level less than the pressure of saturated water vapors. As a result the cavitation centers emerge and grow in a liquid stream. With the further liquid motion in the expanding channel of a conical segment 11 a gas-and-drop stream is generated.

The generated stream parameters depend on the cone apex angle forming a conical diffuser (segment 11) hereto. At the conical surface apex angle value less than 10° the liquid does not separate from the conical segment 11 walls or partially separates periodically sticking to one or the other part of the conical wall. This process occurs with frequency within the range of 10 to 50 Hz. At the angle value greater than 10° the stream completely separates from the channel walls and the space between them and slightly diverging stream (divergence angle 1 to 1.5°) is filled with air vortices (in stream effluxing into the air).

In case when the conical surface apex angle value exceeds 50°, the nozzle performance is almost the same as that of a cylindrical channel with a flat end surface. The vortices reduce in their size but the frequency of their growth increases. These vortices effect only the surface layers of a stream generated, the nucleus of the stream remaining non-disturbed.

With the selection of an optimum angle at conical surface apex forming a nozzle (within the range of 10° to 50° according to the Invention) there arise large-scale vortices ejected by the air flow. These vortices swing the whole stream of the liquid, which turns to be saturated with vapor and air. At the stream outflow from the nozzle there occurs a collapse of large-sized gas-phase formations in the flow of liquid.

As a result of phenomena described a vapor-and-air saturated liquid stream is produced, which is crushed into the finest drops while colliding with the flame arm 8 base, a set screw 7 and a gas-and-drop stream diffuser element 9. Thereby reduction of a drop size is achieved in the gas-and-drop stream with conservation a high kinetic energy of the drops. On account of this a finely-dispersed gas-and-drop stream of a long range is generated. This on the whole allows to increase fire extinguishing efficiency with application of sprinklers with an optimized insertion-spray 3 channel configuration.

This result is obtained only with the length of a cylindrical 'segment of the channel0-fold greater than the diameter of this segment. With a shorter length of a cylindrical segment the cavitational inclusions in the liquid fail to generate at the outlet of this segment. An excessive increase of a cylindrical segment length is also undesirable, since in this case the energy losses increase due to liquid flow friction against the channel walls. It is preferred to select the length of this segment with water spray in the range of 2 to 10 mm.

As a result of the tests conducted it was established that a sprinkler embodied according to the above modification provides generation of finely-dispersed gas-and-drop streams with an average size of drops 120 μm. The area of the room protected is 21 $m^2$ hereof. It should be noted that conventional sprinkler structures (e.g., 25699 Grinell AM-type sprinkler) under analogous circumstances allow to generate gas-and-drop stream with an average size of the drops 380 μm, the area of the room protected against the fire not exceeding 6 $m^2$.

The sprinkler, the structure of which corresponds to the second alternative embodiment, functions in the same manner.

With water fed under the pressure of 0.4 to 1.2 MPa into the sprinkler channel inlet the flow is bifurcated proportionally to passage cross-section ratio of the axial channel 12 and the annular channel 13 with helical guide components. The water flow through the annular channel 13 is preferred to amount to 1 up to 2 flows through the axial channel 12. Passing through helical rectangular channels formed by a multi-thread screw, a four-thread screw, in particular, the liquid flow is twisted acquiring a tangential component of a motion speed. Due to this fact the liquid flow turns into a hollow rotating cone at the insertion-spray 3 channel outlet. The thickness of this hollow cone "walls" decreases with its expansion behind the insertion-spray 3 channel outlet section.

Passing through the axial channel 12 the liquid outflows through its outlet in the form of a directed stream transformed into a gas-and-drop flow. The length of the axial channel 12 must provide a cylindrical stream shape with its negligible friction against the channel walls. The optimum length of the channel 12 is 1.5 to 2 of its diameters. The liquid stream out-flowing from the channel 12 then collides with the end of a set screw 7 fixed at the frame arm 8 base. The stream dramatically changes its direction and configuration hereof turning into a liquid sheet, which becomes thinner in the direction from the axis of the channel 12 symmetry. This process takes place in the same manner as in sprinklers of a conventional design.

As a result two high-speed sheets are produced, which collide in the immediate vicinity of the body. A conical rotating sheet generated, while liquid outflows from the annular channel 13 with helical guide components in the form of a four-thread screw, has a divergent angle of 60° to 90°. The sheet generated under collision of an axial flow effluxing from the channel 12, with a set screw 7 and frame arms 8, develops a sheet-type flow with a divergent angle of approximately 150°.

As a result of mixing these two flows a single finely-dispersed gas-and-drop stream is generated due to disturbances arising in them. The size of the drops in the stream generated is almost two times as less than that in each particular flow. This is connected with the fact that thin streams of liquid are formed at the periphery of conventional axisymmetric sheet-type streams. The speed of liquid drops in the said streams dramatically decreases in the efflux direction on account of the stream expansion and friction against the air medium.

A tangential component of the drop speed in a common stream generated, which is connected with the efflux through the annular channel 13 with helical guide components, contributes to a more uniform stream of the drops formation. The said stream is not influenced by the obstacles (frame arms 8 or a set screw 7) located in the vicinity of a stream impact point, since the impact of conical flows and, correspondingly, generation of a common gas-and-drop stream takes place beyond the sprinkler structural components. Under collision and mixing of the flows effluxing through the axial 12 and annular 13 channels a fine gas-and-drop stream is generated with a uniform flow distribution by azimuth. The size of the drops in the gas-and-drop stream generated is 60 to 400 μm.

Therefore, in applying the above sprinkler design it is possible to generate a fine and space-uniform stream of drops without increasing liquid consumption and pressure. In addition, there is no necessity to mount a gas-and-drop flow diffuser element 9 on a sprinkler body 1 (see FIG. 1), which, on the whole, simplifies a structure and reduces non-productive kinetic energy losses of the drops. With availability of the said diffuser element in the sprinkler structure the size of the drops increases and the initial speed of the drops decreases.

As a result of the tests conducted it was established that a sprinkler embodied according to a described alternative modification provides generation of fine gas-and-drop streams with an average size of the drops 125 μm. The area of the room protected is 12 m2 hereto. Water flow and its supply pressure for a sprinkler designed according to the above-described embodiment does not exceed the corresponding parameters for conventional sprinklers (e.g., for AM 25699 Grinnel-type sprinkler).

The said knowledge confirms a possibility of achieving technical result with the help of a sprinkler embodied according to the present invention in different alternative embodiment modification. The invention yields generation of a uniform fine gas-and-drop liquid flow of a high kinetic energy and space-uniform distribution, which allows to increase the area of the room protected against the fire.

The invention may be used for fire extinguishing equipment, namely: in stationary sprinkler systems for local fire extinguishing in buildings with a great number of potential fire sites. These systems may be used in hospitals, libraries, museums, administration buildings, department stores, storehouses, garages. A sprinkler embodied according to the invention may be used as a part of automatic fire extinguishing units comprising a monitor sensor and a control system. Sprinklers of the structure described may be mounted with the help of a standard releasable connector on the main pipelines of operating fire extinguishing systems instead of obsolete structure sprinklers.

Although the alternative embodiment modifications of the invention were described as they apply to the preferred embodiment of realization, it will be apparent to those skilled in the art that sprinkler modifications and other structural embodiments may be used without deviation from the subject matter of the invention characterized by what is claimed.

The invention claimed is:

1. A sprinkler comprising a body (1) and a channel for liquid supply, a thermally responsive unit with a valve (4) and a thermally responsive unit attachment, wherein the channel is formed by a segment (10) of cylindrical configuration connected with a segment (11) made in the form of a conical diffuser, characterized by the fact that a length of the cylindrical segment (10) exceeds a diameter of the channel formed by the cylindrical segment, a length of the segment (11) in the form of a conical diffuser exceeds the diameter of the channel formed by the cylindrical segment (10), and a cone apex angle forming the surface of the conical diffuser is 10° to 50°.

2. The sprinkler of claim 1, characterized by the fact that the length of the cylindrical segment (10) does not exceed three diameters of the channel formed by the cylindrical segment.

3. The sprinkler of claim 1, characterized by the fact that the thermally responsive unit attachment is made as frame arms (8) embracing the thermally responsive unit.

* * * * *